United States Patent [19]

Holpuch et al.

[11] 4,214,502

[45] Jul. 29, 1980

[54] SPECIAL EFFECTS CIRCUIT FOR AN ELECTRONIC ORGAN

[75] Inventors: Robert J. Holpuch, Palatine; Robert G. Mathias, Brookfield; Alan C. Young, Park Ridge, all of Ill.

[73] Assignee: Marmon Company, Chicago, Ill.

[21] Appl. No.: 875,847

[22] Filed: Feb. 7, 1978

Related U.S. Application Data

[63] Continuation of Ser. No. 697,468, Jun. 18, 1976, abandoned.

[51] Int. Cl.[2] ..... G10H 1/02

[52] U.S. Cl. ..... 84/1.24; 84/1.01; 84/1.03; 84/1.11; 84/1.19; 84/DIG. 9

[58] Field of Search ..... 84/1.01, 1.03, 1.11, 84/1.19, 1.24, DIG. 9, 1.17

[56] References Cited

U.S. PATENT DOCUMENTS

| | | | |
|---|---|---|---|
| 3,629,482 | 12/1971 | Pulfer et al. | 84/1.03 |
| 3,688,010 | 8/1972 | Freeman | 84/1.24 X |
| 3,787,601 | 1/1974 | Campbell | 84/1.03 |
| 3,828,110 | 8/1974 | Colin | 84/1.01 |
| 3,861,263 | 1/1975 | Okudaira | 84/1.03 X |
| 3,929,051 | 12/1975 | Moore | 84/1.17 |
| 3,974,729 | 8/1976 | Koike | 84/1.03 |

*Primary Examiner*—Ulysses Weldon

*Attorney, Agent, or Firm*—Neuman, Williams, Anderson & Olson

[57] ABSTRACT

A special effects circuit for use in an electronic musical instrument, preferably an electronic organ, including a filter circuit having variable bandpass characteristics and a tone source supplying a signal to the input of the filter circuit. The bandpass characteristics of the filter circuit are modified in accordance with a control signal. Upon the occurrence of an input signal, a control circuit provides the filter circuit with the control signal at a random or pseudo-random value. The instrument player may select the source of input signals from a variety of sources within the organ thereby determining the times or frequency at which the control signal changes but the value of the control signal is random or pseudo-random. The tone signal output from the filter circuit has randomly or pseudo-randomly attenuated frequency characteristics and is coupled to standard organ output circuits for audio presentation.

3 Claims, 5 Drawing Figures

SPECIAL EFFECTS CIRCUIT FOR AN ELECTRONIC ORGAN

This is a continuation of application Ser. No. 697,468 filed June 18, 1976 now abandoned.

BACKGROUND OF THE INVENTION

The present invention relates to a special effects circuit for use in electronic musical instruments preferably electronic organs. As the instrument player is engaged in playing, it is frequently desirable to automatically and variably attenuate or accentuate a portion of the audio frequency signal to provide a musically pleasing change in the output tone signal. This attenuation or accentuation of a portion of the frequency range produces a constantly but irregularly changing characteristic in the tone output signal.

In prior art devices for electronic organs, the instrument player could manually vary the resonance point of a filter which altered the frequency characteristics of a tone signal. An improvement on the manual operation was provided in U.S. Pat. No. 3,569,603 issued to Donald Kern and entitled: Moving Formant Band-Pass Amplifier For An Electronic Musical Instrument which included a circuit to provide a signal envelope to vary the resonance point of a filter in the identical manner each time that the circuit was actuated. This prior art device provided an output tone signal which is attenuated in the identical manner each time the circuit was actuated. Of course, audio frequency synthesizers such as those developed by Moog and others are well known. These devices alter the wave shape and frequency characteristics of audio frequency signals to produce different audio outputs.

SUMMARY OF THE INVENTION

The present invention is directed to a special effects circuit for use in an electronic organ. An organ audio tone signal is attenuated by a filter circuit having bandpass characteristics which vary in a random or pseudo-random manner determined by a control circuit.

To achieve the attenuated audio tone signal output the instrument player actuates a selection means to choose an input signal for the control circuit from a plurality of available signal sources within the organ such as the rhythm unit. The control circuit comprises a binary counter, the output of which sequences to a new position or value upon the receipt of each input signal pulse from the selected input signal source. Each different output of the counter provides a control signal which varies in a pseudo-random manner and correspondingly varies the bandwidth and/or resonance characteristics of the filter circuit.

The filter circuit comprises a plurality of discrete filters having unique bandwidth and resonance characteristics. Each discrete filter receives at its input an audio frequency tone signal to be attenuated by the filter. The tone signal may be from the upper manual 16 foot bus line or any other audio frequency tone source in the organ. The instrument player can select which audio frequency tone signal present in the organ will be supplied to the filter inputs by controlling a switch. The four bit binary output of the counter circuit controls a switching network which is connected to the input of the discrete filters. Each binary bit output signal from the counter is associated through the switching network with an individual discrete filter. When an individual bit output signal from the counter is in one logic state, the tone signal input to the associated discrete filter is passed to ground via the switching network. However, when an individual bit output signal from the counter is in the opposite logic state, the audio signal input to the associated discrete filter is passed to the filter to be attenuated. Thus, for every input pulse from the rhythm unit, the counter sequences and each different output state of the counter provides a filter control signal which through the switching network allows the audio tone signal to pass to a different combination of discrete filters with a unique total attenuation characteristic.

The discrete filters are arranged in sixteen different combinations corresponding to the binary count of the counter. Thus the value or state of the filter control signal repeats after every cycle of the counter but the period of repetition is so great that the control signal is pseudo-random. The change in attenuation characteristics of the different effective combinations of discrete filters can be predetermined while the rapidity between each change is controlled by the input signal from the rhythm unit.

In an alternative embodiment, the control signal value is random and the bandpass characteristics of a filter circuit are correspondingly varied. The input signal from the rhythm unit or other source is applied to a sample and hold circuit. Upon the occurrence of the input signal, the sample and hold circuit samples the instantaneous voltage level of a non-rectangular waveform generator such as a white noise source. The sampled instantaneous voltage is applied to a voltage controlled filter to vary its resonance point. A tone signal from the organ is coupled to the input of the voltage controlled filter. The sample and hold circuit samples the white noise source each time it receives a pulse from the rhythm unit and maintains the sampled analog voltage level signal at its output as a filter control signal until the occurrence of the next input signal. The instantaneous voltage sampled at the white noise source will be completely random in value. The filter control signal will change at a rate depending on the input signal but the value of the filter control signal will be completely random and the resonance point of the voltage controlled filter will be varied in a random manner. Thus, the frequency characteristics of the tone signal output from the filter will be randomly attenuated.

The random analog voltage control signal from the sample and hold circuit can be made compatible with the discrete filter circuit by the use of a standard analog to digital converter. In a similar manner, the pseudo-random binary control signal from the counter can be made compatible with the voltage controlled filter by the use of a digital to analog converter.

An object of the present invention is to provide a special effects circuit for electronic musical instruments.

Another object of the invention is to provide a special effects circuit including a filter circuit for varying the frequency characteristic of an audio tone signal in response to a pseudo-random control signal.

Another object of the invention is to provide a special effects circuit including a filter circuit for varying the frequency characteristic of an audio tone signal in response to a random control signal.

Other objects of the invention will become apparent by examination of the following detailed description and drawings in which.

DETAILED DESCRIPTION

Figure 1:
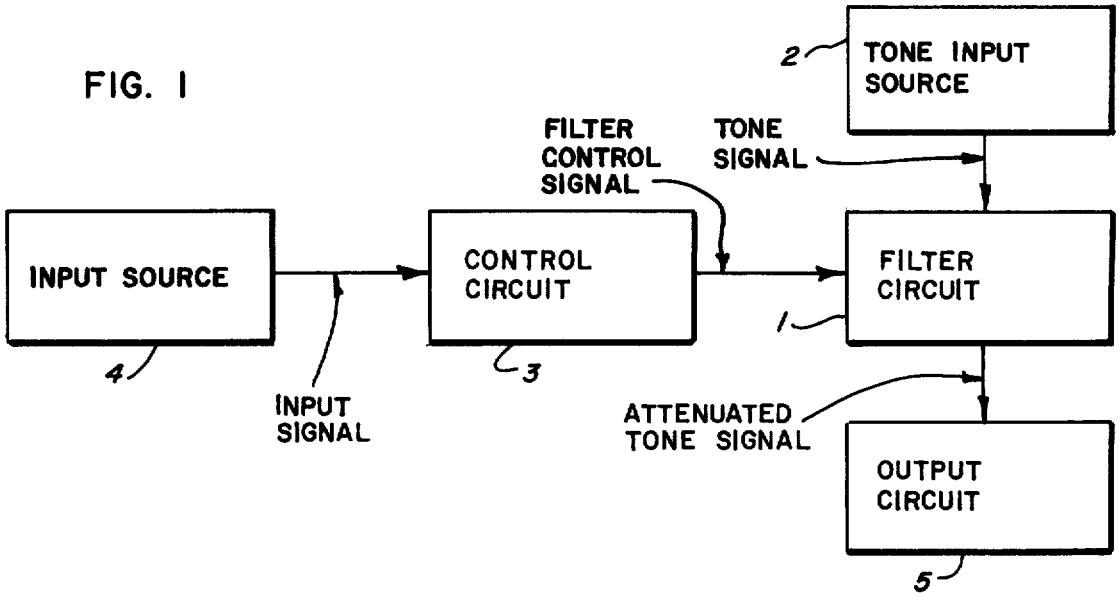
FIG. 1 is a block circuit diagram illustrating the special effects circuit.

FIG. 1 illustrates diagrammatically a special effects circuit for use in an electronic musical instrument such as an electronic organ. It is well-known that in a standard electronic organ one or more tone generators provide tone signals in response to the depression of keys and that a rhythm unit within the organ can provide an automatic and selectable beat to the rhythm voices such as bass drum, cymbals or others. The tone signals are passed through standard filters and output circuits for audio presentation. There are numerous other special circuits to provide controls and variations in the tone signals, such as the legato unit which provides a pulse output upon the depression of any key even though another key is previously depressed. The standard electronic organ is well-known in the art and further description is unnecessary.

A variable filter circuit 1 receives a tone signal from a tone source 2 comprising one of a plurality of available sources within the organ such as the upper manual 16 foot bus line. For the purpose of modifying the attenuation characteristics of the filter circuit 1, there is provided a control circuit 3. The control circuit 3 is responsive to the occurrence of an input signal from one of a plurality of input sources 4 such as the rhythm unit, legato unit or swell pedal switch. The control circuit provides a filter control signal in response to the occurrence of the input signal but the value of the control signal changes in a functionally random manner. The term functionally random includes both random and psuedo-random.

Each time the value of the control signal changes, the bandpass characteristics of the variable filter circuit 1 are modified. As these characteristics of the filter circuit 1 are modified, a different frequency range of the tone signal is attenuated. The characteristics of the filter circuit change at a rate based upon the frequency of a selectable input signal and in a manner or degree dependent upon the functionally random value of the control signal to produce an attenuated tone output signal which varies in frequency characteristics in accordance with the value of the control signal. The attenuated tone output signal from variable filter circuit 1 is passed to a standard electronic organ output circuit 5 for audio reproduction.

Figure 2:
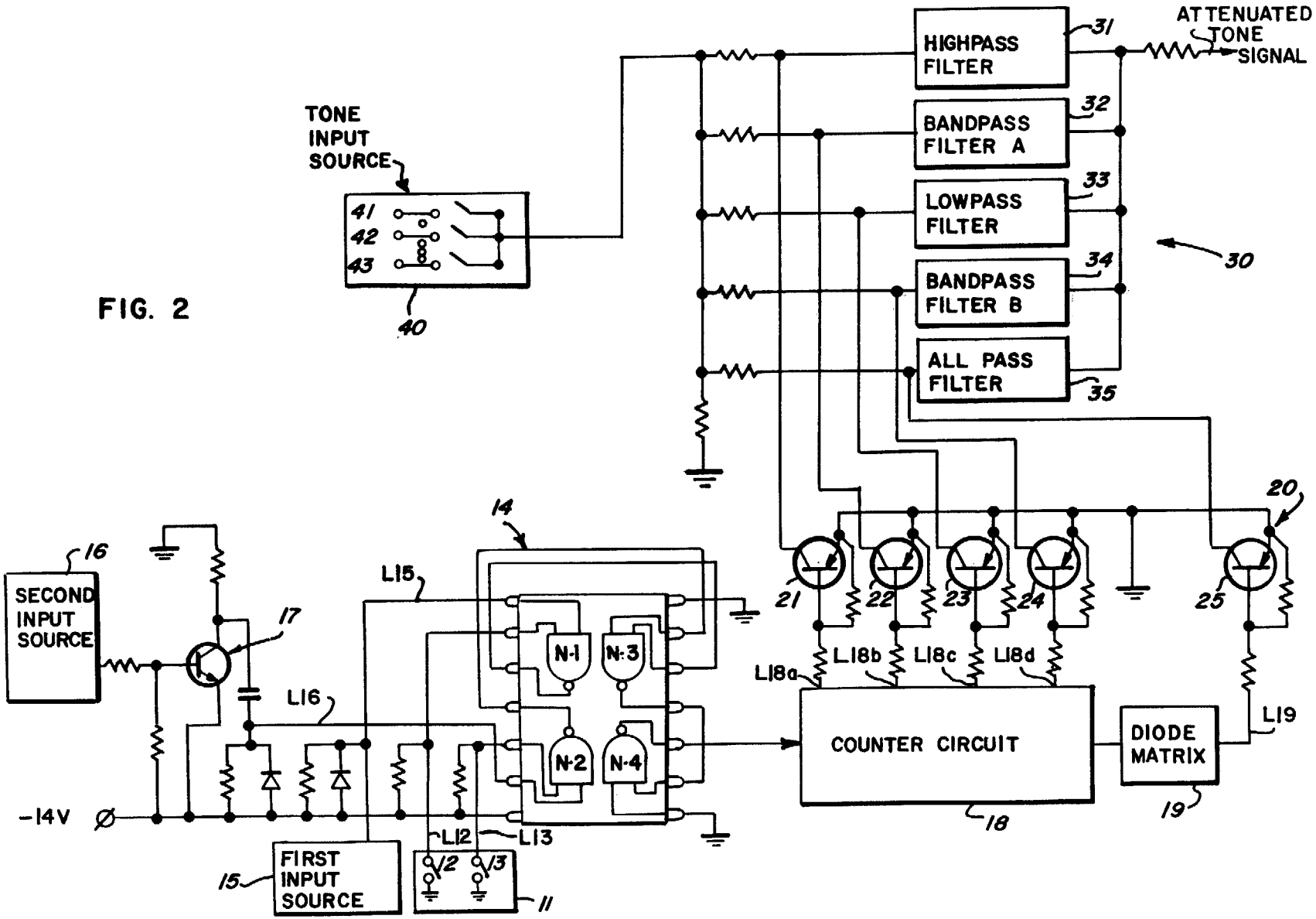
FIG. 2 is a partial schematic showing the preferred embodiment of the special effects circuit.

FIG. 2 illustrates a preferred embodiment of the special effects circuit. At the outset, it should be noted that the logic circuitry operates based upon a logic theory in which zero volts represents the binary logic state of 1, and −14 volts represents the binary logic state of zero. It should be apparent that any other logic theory could be substituted with appropriate circuit modifications. To activate the special effects circuit, the instrument player selects a desired input signal by closing one of the switches in selection means 11. The switches 12 and 13 of the selection means 11 are located on the organ panel adjacent the keyboard and within convenient reach of the instrument player. The selection means has two output lines L12 and L13 which correspond to the switches 12 and 13. The lines L12 and L13 are connected to the input signal logic circuit 14. The logic circuit 14 is a standard logic circuit which comprises four NAND gates N1 through N4. The line L12 is connected to the first input of logic gate N1 and Line L13 is connected to the first input of logic gate N2. Prior to the actuation of the selection means 11, both lines L12 and line L13 are at a zero logic state. The zero logic state signal on lines L12 and L13 hold the outputs of gates N1 and N2 in the one logic state based upon the well-known NAND logic table produced below:

| INPUT | OUTPUT |
|---|---|
| 0 0 | 1 |
| 0 1 | 1 |
| 1 0 | 1 |
| 1 1 | 0 |

A first input signal source 15 is connected via line L15 to the second input of logic gate N1. The first input signal source, in the preferred embodiment, is the legato unit which produces a pulse signal output on line L15 each time a key is depressed even though another key is also depressed. A second input signal source 16 is connected via line L16 to the second input of logic gate N2. The second input signal source is the rhythm unit which produces a pulse output for each beat of the rhythm sequence. It should be noted that other sources of input signals may be selected from sources within the electronic organ. In addition, if more than two input signal sources are employed, a corresponding increase in switches in the selection means 11 and a modification of the logic circuit 14 to accommodate more than two input signals is necessary but within the ability of one ordinarily skilled in the art of logic design. The zero logic signal on lines L12 and L13 maintains the output of gates N1 and N2 at a one logic state independent of the other inputs to these gates.

If the instrument player desires to activate the special effects circuit under the influence of the legato unit, first input source 15, the player must close switch 12 of selection means 11. The closing of switch 12 grounds line L12 to provide a logic signal 1 to the first input of gate N1. The output from the source 15 normally rests at zero volts and pulses to −14 volts to change the logic signal at the second input to gate N1 from a logic 1 to logic 0. Only when both inputs to gate N1 are in the one logic state will the output of N1 change from a logic 1 to a logic zero. The output of gate N1 is received by NAND gate N3 which functions as an OR logic gate to pass a pulse from either gate N1 (controlled by first input source 15) or gate N2 (controlled by second input source 16). The output of N3 is received by NAND gate N4 which functions as an inverter, since one input is grounded to always provide a logic signal of 1. The output of gate N4 changes logic states at the same frequency as the signal from the first input source 15. During the above sequence with switch 12 of selection means 11 closed, the output of gate N2 remains in the one logic state.

If the instrument player desires to activate the special effects circuit under the influence of the rhythm unit, second input source 16, the player must close switch 13 in selection means 11. The closing of switch 13 grounds line L13 to provide a logic signal of 1 to the first input of gate N2. The output from input signal source 16 normally rests at −14 volts, logic state 0, and pulses to zero volts upon receipt of a signal from the rhythm unit. The transistor circuit 17 inverts the positive going pulse to a negative going pulse so that NAND gate N2 will function in the same manner as N1.

Only when both inputs to the gate N2 are in the 1 logic state will the output of gate N2 change from a logic 1 to a logic 0. The output of gate N2 is received by NAND gate N3 which functions as an OR gate. The output from gate N3 is received by NAND gate N4 which functions as an inverter. The output from gate N4 changes logic states at the same frequency as the signal from the second input source 16. It should be apparent that the logic output states of the input signal sources can be arranged in any manner and combination to effect the desired signal output as discussed above by appropriate logic circuits within the ability of one of ordinary skill in the art.

The output of gate N4 controlled by either of the input signal sources 15 or 16 and the switches 12 or 13 respectively is applied as an internal control signal to the input of counter circuit 18. In the preferred embodiment, the counter circuit 18 is a standard four bit binary counter which advances one state in response to a change in the level of the internal control signal. The output signal on lines L18*a* through L18*d* from each of the four bistable devices forming the four bit binary count varies between a logic state of zero and one and together with the output from the diode matrix 19 on line L19 comprises the filter control signal. The diode matrix 19 provides a one logic state on line L19 when lines L18*a* through L18*d* are all in the zero logic state. The sixteen states of the counter are set forth in the logic table below and each column represents one portion of the filter control signal:

| a | b | c | d |
|---|---|---|---|
| 0 | 0 | 0 | 0 |
| 1 | 0 | 0 | 0 |
| 0 | 1 | 0 | 0 |
| 1 | 1 | 0 | 0 |
| 0 | 0 | 1 | 0 |
| 1 | 0 | 1 | 0 |
| 0 | 1 | 1 | 0 |
| 1 | 1 | 1 | 0 |
| 0 | 0 | 0 | 1 |
| 1 | 0 | 0 | 1 |
| 0 | 1 | 0 | 1 |
| 1 | 1 | 0 | 1 |
| 0 | 0 | 1 | 1 |
| 1 | 0 | 1 | 1 |
| 0 | 1 | 1 | 1 |
| 1 | 1 | 1 | 1 |

Thus the filter control signal changes its value for each different count of the counter circuit. The value of the control signal repeats every time the counter cycles but the period is so great that the value of the control signal is pseudo-random.

A switching network 20 receives the filter control signal via the lines L18*a* through L18*d* and L19. The switching network 20 comprises a plurality of devices 21 through 25. Each device 21 through 24 corresponds to an individual output line L18*a* through L18*d* of the counter circuit 18. In the preferred embodiment each device 21 through 25 is a shunt transistor circuit. It should be noted that any other standard gating circuit could be used. The base of each shunt transistor 21 through 24 is connected to one of the output lines L18*a* through L18*d* of the counter circuit 18. The emitter of each shunt transistor is connected via a resistor to its base and is connected to ground. The collector of each shunt transistor is connected to the input of a filter network 30. When the signal on line L18*a* through L18*d* is in a logic state 0, the corresponding shunt transistor 21 through 24 of the switching network 20 is conducting. Any signal present at the collector of a conducting shunt transistor gate is passed to ground. As the counter 18 sequences, the transistor shunt gates 21 through 24 switch from their conducting to non-conducting states. The diode matrix circuit 18 senses the special case when the counter 18 is in the 0 0 0 0 state. The diode matrix provides a 0 logic state at its output to make the device 25 conducting for all positions of the counter except the 0 0 0 0 state. In the 0 0 0 0 state the diode matrix 19 provides a 1 logic state at line L19. The collector of each of the devices 21 through 25 is individually connected to the input of one of a plurality of discrete filter circuits 31 through 35. The discrete filters 31 through 35 each has a different resonance and bandpass characteristic. Since high pass, lowpass, bandpass and all-pass filters are well-known in the art, no further description is necessary.

The tone input signal source 40 is connected to the input of each of the discrete filters 31 through 35 via isolating resistors. The tone signal source 40 comprises a plurality of switches 41 through 43. The instrument player can connect any of the switches to provide an audio tone signal to the discrete filters 31 through 35. In the preferred embodiment, the switch 41 is closed which connects the upper manual 16 foot bus line to the filters 31 through 35. The upper manual 16 foot bus line is the lowest pitch audio frequency signal available.

As the logic state on line L18*a* through L18*d* from counter circuit is changed, the conductivity of shunt transistors 21 through 24 is correspondingly changed. If line L18*a* is in the zero logic state, the shunt transistor 21 is on and the audio frequency signal at the input to filter 31 is passed directly to ground. If the line L18*a* is in the one logic state, the shunt transistor 21 is off and the audio frequency signal at the input to filter 31 is attenuated by the filter 31.

The diode matrix 19 detects when lines L18*a* through L18*d* of the counter circuit 18 are in the logic 0 state. In this condition, the audio input signals to filters 31 through 34 are shunted to ground. A loss of the audio signal output would occur until the counter advances to its next state. The diode matrix 19 and its corresponding device 25 in switching network 20 and all-pass filter 35 prevent this musically undesirable condition. During the first 15 states of the binary sequence of counter circuit 18 the filter control signal output of the diode matrix 19 is a logic 0 and the audio signal at the input to all-pass filter 35 passes through the isolation resistor to ground. When the counter 18 is in the 0 0 0 0 state, the audio signals at the inputs to filters 31 through 34 are shunted to ground, but the diode matrix 19 detects this counter state and changes its filter control signal from the logic 0 to logic one. With a logic output of one on line L19, the device 25 is off and the audio signal is passed through all-pass filter 35 maintaining a continuous audio output signal.

As the output of the counter circuit 18 changes from the 1 to the 0 logic state, the individual discrete filters are effectively switched out of the filter circuit 30 or effectively switched in to form a portion of the filter circuit 30. Thus, as the value of the filter control signal changes value, the bandpass characteristics to the filter circuit are correspondingly modified.

In the preferred embodiment, the high pass filter 31 is responsive to the logic state of line L18*a* and therefore is alternatively in and out of the filter network 30. Since the directional or amplitude characteristics of high frequency audio signals are most readily perceived by the human ear, the combined audio output of the special effects circuit is most noticeably varied by the manipulation of this discrete filter. However, it should be apparent that the resonance and bandpass characteristics of the individual filters and the number of filters are a matter of design and can be varied to suit the selection of the designer. Furthermore, the connection of the output lines L18*a* to L18*d* to the individual filter inputs can be altered without affecting the operativeness of the special effects circuit.

Figure 3:
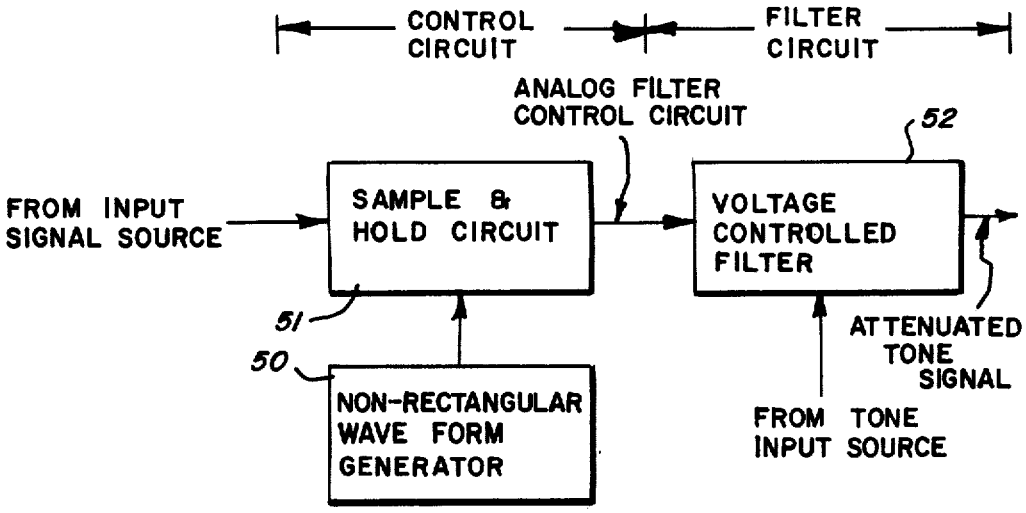
FIGS. 3-5 are block circuit diagrams showing alternate embodiments of the special effects circuit.

FIG. 3 is a block diagram of an alternate embodiment of a portion of the special effects circuit and more specifically an alternate control circuit and an alternate filter circuit.

The alternative control circuit comprises a non-rectangular waveform generator 50 such as a white noise source. In addition, the waveform generator may be a sinewave, rectified sinewave, triangle wave, ramp wave, sawtooth wave, etc. The output of the generator 50 is continually supplied to a sample and hold circuit 51 which, upon the occurrence of a signal from the input source, will hold the instantaneous input voltage level from the generator 50 at its output until the occurrence of another input signal. The input signals can be obtained in the same manner as described with reference to FIG. 2. Sample and hold circuits are well-known in the art and can comprise a switch, capacitor and source follower transistor. The constantly varying input of the generator 50 in conjunction with the sample and hold circuit 51 provides a sampled randomly varying analog filter control signal.

A variable filter circuit receives the analog filter control signal from the sample and hold circuit 51. The variable filter circuit comprises a voltage controlled filter 52. Voltage controlled filters are also well-known in the art and have a varying resonance frequency depending upon the voltage level at their input. Thus, voltage from the sample and hold circuit 51 tunes the filter 52 to a specific resonance frequency, and the filter 52 remains at this resonance point until the sample and hold circuit 51 responds to a pulse or variation of the input signal to sample a different random voltage thereby causing the filter 52 to shift to a different resonance frequency. An audio tone signal is obtained as explained in FIG. 2 and applied to the voltage controlled filter 52. The instantaneous shifting of the resonance point of the filter 52 is not heard, but the audio frequency output signal has a different sound or "voice." Thus the tone signal is variably filtered in a random manner in accordance with the random value of the control signal.

A further musical effect may be obtained if a time constant or time delay circuit (not illustrated) is interposed between the output of sample and hold circuit 51 and the voltage controlled filter 52 to eliminate the instantaneous change in voltage levels so that frequency response changes can be heard while the filter shifts its resonance point. This type of delay circuit may be a simple RC time delay. The delay circuit may be bypassed with a simple switch if desired.

Figure 4:
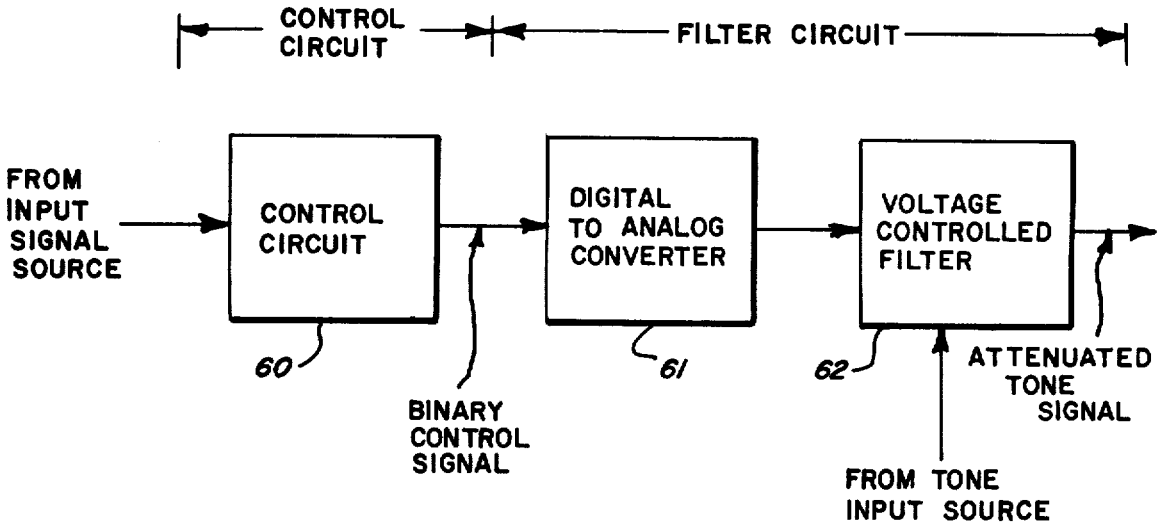

FIG. 4 is a block diagram of another alternate embodiment of the special effects circuit. This embodiment uses a control circuit 60, with a binary output such as that described in FIG. 2. The binary output of the control circuit 60 is received by the binary to analog converter 61. The analog output from converter 61 is applied to the input of a voltage controlled filter 62 as described in reference to FIG. 3. The converter 61 is a well-known device and provides complete interchangeability between the voltage controlled filter circuit and the discrete filter circuit with control circuits having a binary output signal.

Figure 5:
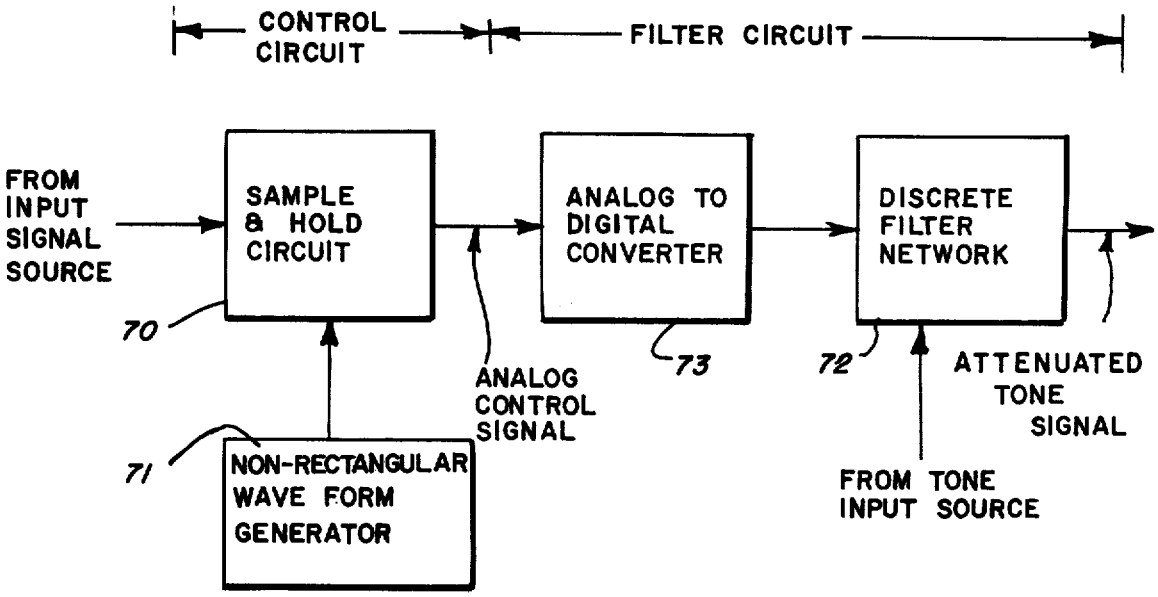

FIG. 5 is a block diagram of another alternate embodiment of the special effects circuit. This figure discloses a sample and hold control circuit 70 in cooperation with a non-rectangular waveform generator such as 71 as described with reference to FIG. 3 interfaced with a discrete filter network 72 as described with reference to FIG. 2. To make the analog filter control signal of the sample and hold circuit 70 compatible with the discrete filter network 72, it is necessary to interpose an analog to digital converter 73. The resulting digital output will provide the appropriate signal for the discrete filter network 72. The converter 72 is well-known in the art and provides complete interchangeability between discrete filter circuits and voltage control filters with control circuits having a binary output signal.

It is to be further understood that the above-detailed disclosure is to be interpreted in its broadest sense and is not to be limited to the specific embodiments disclosed herein. One skilled in the art may employ any number of input or audio signals, discrete or variable filters, and might employ a mutually compatible binary or analog control circuit to accommodate the selected input signals and filter characteristics.

We claim:

1. A special effects circuit for an electronic musical instrument comprising:

a tone signal source having a tone output signal;

an input signal source having an enable output signal;

non-rectangular waveform generator means for producing a continuously varying non-rectangular waveform output signal;

sample and hold circuit means having a control output signal and receiving said continuously varying non-rectangular waveform output signal of said non-rectangular waveform generator means and said enable output signal of said input signal source for sampling the instantaneous signal value of said continuously varying non-rectangular waveform output signal in response to said enable output signal and for holding said sampled instantaneous signal value as said control output signal; and filter circuit means receiving said tone output signal of said tone signal source and said control output signal of said sample and hold circuit means and having bandpass characteristics dependent upon the value of said control output signal for filtering said tone output signal producing an attenuated tone output signal.

2. A special effects circuit as set forth in claim 1 wherein said filter circuit means comprises a voltage controlled filter.

3. A special effects circuit as set forth in claim 1 wherein said filter circuit means comprises:

an analog to digital converter receiving said control output signal of said sample and hold circuit means and converting said control output signal to a digital control signal;

a plurality of discrete filters, each having a unique resonance and bandwidth characteristic and each having an input terminal for receiving said tone output signal from said tone signal source; and a switching network receiving said digital control signal and being connected to each of said input terminals of said filters for gating said tone output signal to different ones of said plurality of filters in accordance with said digital control signal.

* * * * *